US008925634B2

(12) United States Patent
Simonian et al.

(10) Patent No.: US 8,925,634 B2
(45) Date of Patent: Jan. 6, 2015

(54) FLOW RESTRICTOR DEVICE

(75) Inventors: Sam Simonian, Manama (BH); Giovanni Salerno, Manama (BH); Benn Voll, Manama (BH)

(73) Assignee: FloTech Holdings Limited, Tortola (VG)

( * ) Notice: Subject to any disclaimer, the term of this patent is extended or adjusted under 35 U.S.C. 154(b) by 171 days.

(21) Appl. No.: 13/390,788

(22) PCT Filed: Jul. 8, 2010

(86) PCT No.: PCT/GB2010/001314

§ 371 (c)(1),
(2), (4) Date: May 22, 2012

(87) PCT Pub. No.: WO2011/004161

PCT Pub. Date: Jan. 13, 2011

(65) Prior Publication Data

US 2012/0227979 A1 Sep. 13, 2012

(30) Foreign Application Priority Data

Jul. 10, 2009 (GB) ..... 0912030.4

(51) Int. Cl.

| | |
|---|---|
| ***E21B 34/00*** | (2006.01) |
| ***E21B 34/06*** | (2006.01) |
| ***E21B 34/08*** | (2006.01) |
| ***E21B 41/00*** | (2006.01) |

(52) U.S. Cl.

CPC ..... *E21B 34/06* (2013.01); *E21B 34/08* (2013.01); *E21B 41/00* (2013.01)

USPC ..... 166/332.3; 166/329; 166/369

(58) Field of Classification Search

CPC ..... E21B 34/06; E21B 41/00; E21B 34/08; E21B 43/00; E21B 34/00

USPC ..... 166/369, 329, 318, 332.3, 334.2

See application file for complete search history.

(56) References Cited

U.S. PATENT DOCUMENTS

| | | | | |
|---|---|---|---|---|
| 2,132,081 | A | 10/1938 | Nixon | |
| 2,340,481 | A | 2/1944 | Lloyd | |
| 5,127,474 | A | 7/1992 | Schroeder, Jr. et al. | |
| 6,966,368 | B2 * | 11/2005 | Farquhar | 166/128 |
| 7,828,059 | B2 * | 11/2010 | Reid et al. | 166/250.15 |
| 2007/0151734 | A1 * | 7/2007 | Fehr et al. | 166/305.1 |
| 2009/0084556 | A1 | 4/2009 | Richards et al. | |

OTHER PUBLICATIONS

Search Report for PCT Application No. PCT/GB2010/001314 issued Apr. 7, 2011.

Written Opinion for PCT Application No. PCT/GB2010/001314 issued Apr. 7, 2011.

International Preliminary Report on Patentability for PCT Application No. PCT/GB2010/001314 issued Jan. 10, 2012.

* cited by examiner

*Primary Examiner* — Yong-Suk (Philip) Ro

(74) *Attorney, Agent, or Firm* — Meyertons, Hood, Kivlin, Kowert & Goetzel, P.C.; Eric B. Meyertons

(57) ABSTRACT

A flow restrictor device for production tubing comprising an obstructing member. The flow restrictor is arranged for movement between a first position where the obstructing member is located so as to form a seal with an edge of an aperture formed in a wall of said production tubing and is arranged to prevent fluid flow through said aperture, and a second position where the obstructing member is located so that the aperture is unobstructed. The flow restrictor further comprises a retaining arrangement for restricting possible locations of said obstructing member to said first position, second position and positions therebetween. The aperture allows fluid communication between the exterior and interior of the production tubing.

20 Claims, 1 Drawing Sheet

FLOW RESTRICTOR DEVICE

FIELD OF THE INVENTION

The present invention relates to a flow restrictor device and particularly, but not exclusively, to a flow restrictor device for an oil well.

BACKGROUND TO THE INVENTION

When an oil well is drilled it passes directly through an oil reservoir from which oil will be produced to the surface. A bore is drilled into the oil reservoir and a production string is introduced into the bore. Production tubing string is made up of individual tubing sections approximately 9.1 meters (30 feet) long. Attached to the top end of each tubing section is a coupling with two female thread forms to allow corresponding male threads on the end of the tubing sections to be threaded together to create one continuous tubing string.

The rock which makes up the oil reservoir may vary in type and physical characteristic, but the main characteristic of interest is the permeability of the rock. The permeability determines the ease with which the oil can flow through the rock and into the oil well.

Certain rocks such as sandstone have a relatively even permeability and are called homogeneous. Oil can flow through the homogeneous rock at a relatively even pace and will be produced evenly across the drilled section of reservoir. Other reservoir rocks such as limestone and chalk can be heavily, naturally fractured and vary greatly in permeability. These rocks are known as heterogeneous. Oil from a heterogeneous reservoir will produce mainly from the areas of highest permeability where the fractures occur.

Even through the oil well may be drilled through a considerable length of the oil reservoir, the high permeability zones may account for only 10-15% of the length of the drilled reservoir section. If allowed to produce directly into the drilled hole and production tubing string, the oil will never be produced from the remaining 85-90% of the drilled section thus reducing the efficiency of the oil well.

Another problem is that directly beneath the oil reservoir there is typically a layer of naturally occurring water. When a well is drilled the aim is to produce as much oil as possible and to limit the amount of natural water produced. Over time as the oil is depleted, it is replaced by the natural water seeping up from the rock below. In a homogeneous reservoir the water may rise slowly and evenly, prolonging the time before water eventually breaks through into the well bore. In a heterogeneous reservoir the mixed permeability of the reservoir and the natural faulting may allow water to be produced almost immediately at the expense of oil production.

To overcome these problems of producing oil from a heterogeneous oil reservoir a number of mechanical components have been designed to control the flow of oil into the production tubing string. Historically the oil was allowed to flow from the hole drilled through the reservoir directly into the production tubing string via the open end of the tubing string or via holes drilled evenly along the length of the tubing string. This method of production made no difference to the permeability of the reservoir and resulted in production from a limited portion of the drilled section leading to early water break-through.

It was discovered that if the flow of oil from the reservoir could be mechanically restricted as it passed into the tubing string, the resulting back pressure created would allow sections of the reservoir with lower permeabilities that would not normally get a chance to produce, due to the higher permeability zones, to contribute to the well's production. This effectively increased the oil producing area of the reservoir and extended the time before eventual water break-through.

Devices which invoke this effect come in a variety of forms and have the common feature of restricting flow by creating a pressure drop as the oil passes through them. The restriction can take the form of a series of orifices or a tortuous flow path. The devices are provided in the production tubing string and are spaced out at intervals across the reservoir section. As the oil produces it will pass out of the oil reservoir rock and fill the annular space between the bore hole drilled through the reservoir and the outside of the production tubing string. Thereafter, the oil will flow towards the flow restriction devices and enter the production tubing string.

The substantially continuous annular space between the bore hole drilled through the reservoir and the outside of the production tubing string can be effectively partitioned into a number of compartments by the location of collars around the production tubing at regular intervals. These collars are spaced from the flow restriction devices in a longitudinal direction and each compartment may comprise at least one flow restriction device.

These collars are commonly known as mechanical open-hole packers, and these packers form a barrier between adjacent compartments. In the event that water was to break-through to one compartment, the packers serve to isolate adjacent compartments and prevent the water flowing into adjacent compartments in the annular space between the bore hole drilled through the reservoir and the outside of the production tubing string.

The packers are fitted to, and sealed around, a completion liner and then inserted into the well. Existing mechanical open-hole packer seal technology uses packers formed of a seal of deformable elastomer material. After the completion section is placed in the reservoir, the packers are set against the open-hole section of the reservoir by pressurising a piston seal assembly which serves to drive a mechanism which transversely deforms the packer seal along the direction of the completion liner. Actuating the packer in this manner causes it to deform in a transverse/radial direction forming a seal between the completion liner and the open-hole section of the reservoir.

It is also known for packers to be formed of a material which is arranged to expand, i.e. swell, as a result of contact with, for example, a liquid found in, or in the vicinity of, the reservoir, so that the packer expands to seal the space between the completion liner and the well wall.

European Patent Application No 08104394.5 relates to mechanical packers suitable for the applications described above.

These mechanical packers can be set by pumping fluid into the production tubing from the surface to increase the pressure within the production tubing compared to that exterior to the tubing. The pressure within the production tubing is maintained at a specific level for a period of time to ensure that all mechanical packers are set. However, the flow restriction devices are, in their simplest form, apertures formed in the walls of the production tubing and through which the fluid being pumped into the production tubing can escape to the exterior to the tubing, thereby causing a loss in pressure within the production tubing. As will be appreciated, these leaks can cause difficulties in maintaining the required pressure within the production tubing and can increase the time required to set the mechanical packers.

The mechanical packers can also be set by way of a setting tool. However, the use of such a tool represents extra operational expense because each packer has to be set individually, and if there are, for example, ten mechanical packers in a well, this can typically equate to an extra twenty-four hours of operation.

SUMMARY OF THE INVENTION

According to an aspect of the present invention, there is provided a flow restrictor device for production tubing comprising: an obstructing member or means arranged for movement between a first position where said obstructing member or means is located so as to form a seal with an edge of an aperture formed in a wall of said production tubing and is arranged prevent fluid flow through said aperture, and a second position where said obstructing member or means is located so that the aperture is unobstructed; and a retaining arrangement or means for restricting possible location of said obstructing member or means to said first position, second position and positions therebetween.

In use, as fluid is pumped into the production tubing, the pressure increase effected within the tubing can cause the obstructing member or means to move to form a seal with the edge of the aperture, thereby effectively blocking the aperture and preventing the escape of fluid from the production tubing to the exterior thereof through the aperture. Thus, during a mechanical packer setting process, the obstructing member or means prevents leakage from the production tubing.

Inducing a differential pressure between the reservoir and the interior of the production tubing so that the pressure within the production tubing is lower than that of the reservoir will cause the obstructing member or means to move away from the first position under the influence of flow of fluid from the reservoir to the production tubing.

These features may serve to minimise operational costs incurred during installation of the production tubing since the requirement for specialist tools may be minimised or eliminated.

The retaining arrangement or means may be configured to form a cage around the obstructing member or means.

The retaining arrangement or means may comprise a plurality of elements spaced about a periphery of said aperture and arranged to project therefrom, the plurality of elements forming part of an enclosure in which the obstructing member or means is moveable. The plurality of elements may have at remote ends thereof means forming the remainder of the enclosure, said means arranged to prevent escape of the obstructing member or means from an end of the enclosure.

The obstruction member or means may comprise a spherical element, such as a ball.

The obstruction member or means may comprise one or more components.

The obstruction member or means may comprise a pressure relief arrangement, such as a frangible portion configured to rupture upon exposure to a predetermined pressure. This may provide a contingency measure in the event of failure of the obstructing member or means to move from the first position.

The flow restrictor device may comprise an insert member arranged for location in said aperture formed in a wall of said production tubing, wherein the insert member is formed with an aperture which is arranged for fluid flow therethrough and such that, when the insert member is located in said aperture formed in a wall of said production tubing the aperture of the insert member acts as the aperture of the production tubing.

The insert member may be configured to be threadably mounted within an aperture of the production tubing. At least one aperture of said production tubing may be provided with a thread for engagably receiving said insert member which is similarly provided with an external thread.

According to another aspect of the present invention, there is provided an insert member for use as an insert member described above.

According to another aspect of the present invention, there is provided a pipeline system comprising a plurality of pipe sections and a plurality of flow restrictor devices as described above.

The pipeline system may define a production pipeline. The pipeline system may comprise or define a completion arrangement.

A further aspect of the present invention relates to a production tubing arrangement comprising:

- a production tubing defining an aperture within a wall thereof, wherein a flow restrictor device is mounted within the aperture, said flow restrictor device comprising:
  - an obstructing member arranged for movement between a first position where said obstructing member is located so as to form a seal with an edge of the aperture to prevent fluid flow through said aperture, and a second position where said obstructing member is located so that the aperture is unobstructed; and
  - a retaining arrangement for restricting possible locations of said obstructing member to said first position, second position and positions therebetween.

The production tubing arrangement may further comprise a fluid pressure actuated assembly mounted on the production tubing.

The production tubing arrangement may further comprise a fluid pressure actuated packer assembly mounted on the production tubing.

Another aspect of the present invention relates to a method of producing a fluid from a subterranean formation, comprising:

- inserting a production tubing into a wellbore which intercepts a formation, wherein the production tubing defines an aperture in a wall thereof and comprises an obstructing member configured to selectively seal the aperture, and at least one fluid pressure actuatable assembly mounted on the production tubing string;
- providing pressurised fluid from a remote location internally of the production tubing to actuate the fluid pressure actuatable assembly, wherein said pressurised fluid acts on the obstructing member to move said member to seal the aperture; and
- reducing the pressurised fluid to cause fluid from the formation to act on the obstructing member to move said member to open the aperture and permit flow of formation fluids through the aperture into the production tubing.

The fluid pressure actuatable assembly may comprise a fluid actuated packer assembly. The method may comprise providing pressurised fluid from a remote location to actuate the packer assembly to establish a seal between the production tubing string and a wall of the wellbore;

BRIEF DESCRIPTION OF THE DRAWINGS

The present invention is described further hereinafter, by way of example only, with reference to the accompanying drawings in which.

DETAILED DESCRIPTION OF THE DRAWINGS

Figure 1A:
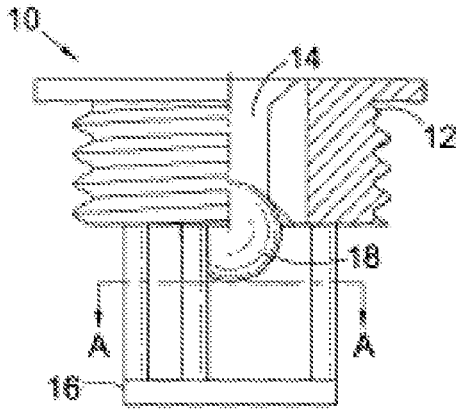
FIG. 1*a* illustrates a partial cross-sectional, side view of a flow restrictor device as configured during a mechanical packer setting operation.

FIG. 1 illustrates a flow restrictor device 10, which comprises four main components, namely: a body 12; an orifice 14; a cage 16; and an obstructing member or means 18 in the form of a ball.

The body 12 of the flow restrictor device 10 is formed so as to be locatable in apertures formed in walls of production tubing. The body 12 may engage with an aperture formed in the production tubing by any suitable means. In the embodiment shown the aperture is provided with a screw thread, with such a thread arranged to mate with a corresponding thread provided on the exterior of the body 12. Thus, the body 12 can be threaded directly into an aperture of the production tubing.

An orifice 14 is formed/provided in said body 12 and is arranged such that, when the flow restrictor device 10 is located in an aperture of the production tubing, there is fluid communication between the exterior and interior of the production tubing through the orifice 14.

The orifice 14 is of a given diameter to create a specific pressure drop for a specific flow rate of oil and water. An operator can pre-set a desired pressure drop for a given flow rate by altering the number of flow restrictor devices 10 in the production and/or the size of the orifice 14.

Cage 16 is located adjacent orifice 14 and is arranged to enclose the obstructing member 18. The obstructing member 18 is free to move within the cage 16 between a first position and a second position and can be located at said first position, said second position and positions therebetween.

The obstructing member 18 is illustrated in the first position in FIG. 1*a*, and in the second position in FIG. 1*b* (discussed further below).

When in the first position, the obstructing member 18 is located such that it is seated against a peripheral edge of the orifice 14 so as to form a seal therewith.

During a setting procedure of mechanical packers (not shown) located around production tubing, pressurising fluid is pumped into the production tubing by way of surface pumps such that a certain downhole pressure is reached to set the packers. It will be appreciated that the pressurising fluid can enter the reservoir via the orifice 14 (backward flow). However, as the surface pump rate is increased, to increase the bottom hole pressure, the obstructing member 18 is urged against the seat of the orifice 14, thereby blocking the flow path of the pressurising fluid from the production string to the reservoir (as illustrated in FIG. 1*a*). By blocking this flow path, a seal is made which isolates the inside of the production string. The pump rate is kept constant until the desired surface pressure (downhole pressure) is achieved. At a certain surface pressure reading (e.g. ~3000 psi), the mechanical packers will start to "set", and by maintaining this pressure for approximately 2 to 3 minutes activates the pressure mechanism in the mechanical packers to allow them to fully set. Once the mechanical packers are set, the pump is stopped and operations are complete.

Once the mechanical packers are set, the well can be brought into production. A surface choke valve is opened to induce flow of the reservoir fluid from the reservoir to the production tubing by way of the orifice 14. The differential pressure between the reservoir and the production tubing causes the obstructing member 18 to be displaced from the first position to the second position illustrated in FIG. 1*b*. The reservoir fluid can then pass through the orifice 14 and hence to surface. The obstructing member 18 is retained proximate the orifice 14 by way of cage 16 which prevents the obstructing member 18 escaping to surface.

Figure 1B:
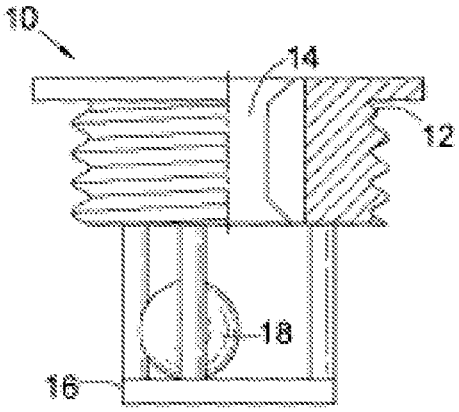
FIG. 1*b* illustrates a partial cross-sectional, side view of the flow restrictor device as configured during well production.
Figure 1C:
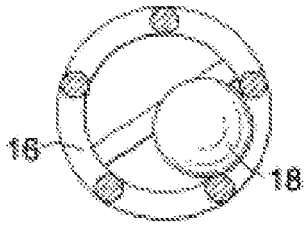
FIG. 1*c* illustrates a cross-sectional view of the flow restrictor device of FIG. 1*a* taken along the line A-A.

FIG. 1*c* illustrates a cross-sectional view of the flow restrictor device of FIG. 1*a* taken along the line A-A. The features illustrated in FIG. 1*c* which correspond to features already described in relation to FIG. 1*a* are denoted by like reference numerals and will not be discussed further.

Figure 2:
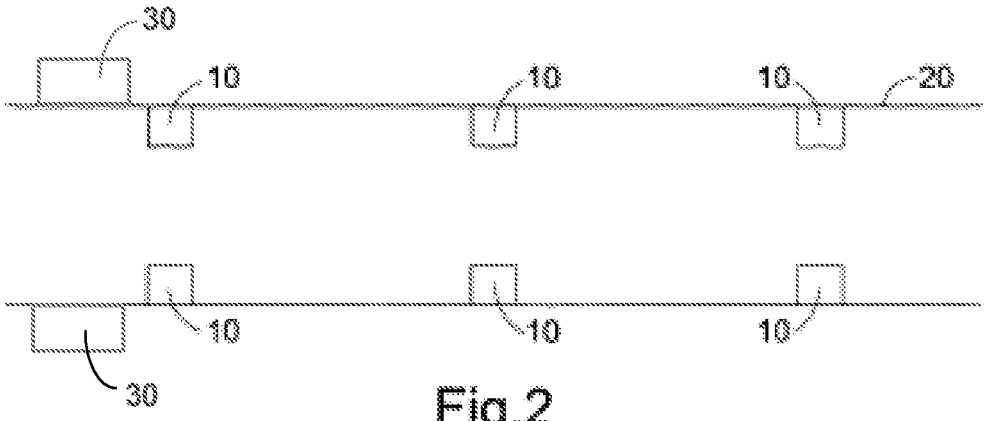
FIG. 2 illustrates a cross-sectional side view of a production tubing string and comprising a plurality of flow restrictor devices according to the present invention.

FIG. 2 illustrates a cross-sectional side view of a production tubing string 20 provided with a plurality of flow restrictor devices 10. As will be appreciated, the flow restrictor devices 10 are evenly spaced along the length of the production tubing string 20. However, in alternative arrangements, this need not be so. A fluid pressure actuated packer assembly 30 is mounted on the production tubing string 20.

In order to resist erosion from the produced fluid over time, the flow restrictor device is preferably manufactured from a very hard, wear-resistant, material such as tungsten carbide.

The present invention may also be incorporated into a production tubing string which is provided with a sand screen. The sand screen may comprise a sleeve arrangement located around the production tubing string, with the sleeve arrangement having perforations formed therein. The sleeve arrangement is arranged to act as a filter to prevent sand and/or other debris from reaching the orifices of the flow restrictor devices and entering the production tubing string and/or blocking the orifices.

Although the flow restrictor device described above has been described in an arrangement where the device can be inserted into an aperture of a production tubing string, the device may also comprise a retaining arrangement or means formed integrally with the production tubing string such that the retaining means is located around an aperture of the production tubing string and extends from an interior wall of the production tubing string. Again, the obstructing member is retained within the retaining means.

What is claimed is:

1. A flow restrictor device for production tubing comprising:

an obstructing member arranged for movement between a first position where said obstructing member is located so as to form a seal with an edge of an aperture formed in a wall of said production tubing and is arranged to prevent fluid flow through said aperture, and a second position where said obstructing member is located so that the aperture is unobstructed; and a retaining arrangement for restricting possible locations of said obstructing member to said first position, second position and positions therebetween, the retaining arrangement comprising a plurality of elements spaced about a periphery of said aperture and arranged to project therefrom, the plurality of elements forming part of an enclosure in which the obstructing member is moveable, and the plurality of elements having at remote ends thereof means forming the remainder of the enclosure, said means arranged to prevent escape of the obstructing member from an end of the enclosure, wherein said aperture allows fluid communication between the exterior and the interior of the production tubing.

2. The device according to claim 1, wherein said retaining arrangement is configured to form a cage around said obstructing member.

3. The device according to claim 1, wherein said obstructing member comprises a spherical element.

4. The device according to claim 1 comprising an insert member arranged for location in said aperture formed in a wall of said production tubing, wherein the insert member is formed with an aperture which is arranged for fluid flow therethrough and wherein the aperture of the insert member acts as the aperture of the production tubing.

5. The device according to claim 4, wherein said aperture of said production tubing is provided with a thread for engagebly receiving said insert member which is similarly provided with an external thread.

6. A production tubing arrangement comprising:

a production tubing defining an aperture within a wall thereof, wherein a flow restrictor device is mounted within the aperture, said flow restrictor device comprising:

an obstructing member arranged for movement between a first position where said obstructing member is located so as to form a seal with an edge of the aperture to prevent fluid flow through said aperture, and a second position where said obstructing member is located so that the aperture is unobstructed, wherein said aperture allows fluid communication between the exterior and the interior of the production tubing; and a retaining arrangement for restricting possible locations of said obstructing member to said first position, second position and positions therebetween, the retaining arrangement comprising a plurality of elements spaced about a periphery of said aperture and arranged to project therefrom, the plurality of elements forming part of an enclosure in which the obstructing member is moveable, and the plurality of elements having at remote ends thereof means forming the remainder of the enclosure, said means arranged to prevent escape of the obstructing member from an end of the enclosure.

7. The production tubing arrangement according to claim 6, further comprising a fluid pressure actuatable assembly mounted on the production tubing.

8. The production tubing arrangement according to claim 6, further comprising a fluid pressure actuated packer assembly mounted on the production tubing.

9. A method for producing a fluid from a subterranean formation, comprising:

inserting a production tubing into a wellbore which intercepts a formation, wherein the production tubing defines an aperture in a wall thereof and comprises a flow restrictor device and at least one fluid pressure actuatable assembly mounted on the production tubing string; said flow restrictor device comprising:

an obstructing member arranged for movement between a first position where said obstructing member is located so as to form a seal with an edge of said aperture formed in a wall of said production tubing and is arranged to prevent fluid flow through said aperture, and a second position where said obstructing member is located so that the aperture is unobstructed;

a retaining arrangement for restricting possible locations of said obstructing member to said first position, second position and positions therebetween, the retaining arrangement comprising a plurality of elements spaced about a periphery of said aperture and arranged to project therefrom, the plurality of elements forming part of an enclosure in which the obstructing member is moveable, and the plurality of elements having at remote ends thereof means forming the remainder of the enclosure, said means arranged to prevent escape of the obstructing member from an end of the enclosure, wherein said aperture allows fluid communication between the exterior and the interior of the production tubing;

providing pressurised fluid from a remote location internally of the production tubing to actuate the fluid pressure actuatable assembly, wherein said pressurised fluid acts on the obstructing member to move said member to seal the aperture; and reducing the pressurised fluid to cause fluid from the formation to act on the obstructing member to move said member to open the aperture and permit flow of formation fluids through the aperture into the production tubing.

10. The method according to claim 9, wherein the fluid pressure actuatable assembly comprises a fluid actuated packer assembly, and the method comprises providing pressurised fluid from a remote location to actuate the packer assembly to establish a seal between the production tubing string and a wall of the wellbore.

11. A flow restrictor device for production tubing comprising:

an insert member arranged for location in a first aperture formed in a wall of a production tubing, wherein the insert member is formed with a second aperture arranged for fluid flow therethrough and wherein the second aperture of the insert member acts as the first aperture of the production tubing;

an obstructing member arranged for movement between a first position where said obstructing member is located so as to form a seal with an edge of the second aperture and is arranged to prevent fluid flow through said second aperture, and a second position where said obstructing member is located so that the second aperture is unobstructed; and a retaining arrangement comprises a plurality of elements spaced about a periphery of said second aperture and arranged to project therefrom, for restricting possible locations of said obstructing member to said first position, second position and positions therebetween, wherein said second aperture allows fluid communication between the exterior and the interior of the production tubing.

12. The device according to claim 11, wherein said retaining arrangement is configured to form a cage around said obstructing member.

13. The device according to claim 11, wherein the plurality of elements forming part of an enclosure in which the obstructing member is moveable, and the plurality of elements having at remote ends thereof means forming the remainder of the enclosure, said means arranged to prevent escape of the obstructing means from an end of the enclosure.

14. The device according to claim 11, wherein said obstructing member comprises a spherical element.

15. The device according to claim 11, wherein said first aperture of said production tubing is provided with a thread for engagebly receiving said insert member which is similarly provided with an external thread.

16. A production tubing arrangement comprising:

a production tubing defining a first aperture within a wall thereof, wherein a flow restrictor device is mounted within the first aperture, said flow restrictor device comprising:

an insert member arranged for location in said first aperture, wherein the insert member is formed with a second aperture arranged for fluid flow therethrough and wherein the second aperture of the insert member acts as the first aperture of the production tubing;

an obstructing member arranged for movement between a first position where said obstructing member is located so as to form a seal with an edge of the second aperture to prevent fluid flow through said second aperture, and a second position where said obstructing member is located so that the second aperture is unobstructed, wherein said second aperture allows fluid communication between the exterior and the interior of the production tubing; and a retaining arrangement comprises a plurality of elements spaced about a periphery of said second aperture and arranged to project therefrom, for restricting possible locations of said obstructing member to said first position, second position and positions therebetween.

17. The production tubing arrangement according to claim 16, further comprising a fluid pressure actuatable assembly mounted on the production tubing.

18. The production tubing arrangement according to claim 16, further comprising a fluid pressure actuated packer assembly mounted on the production tubing.

19. A method for producing a fluid from a subterranean formation, comprising:

inserting a production tubing into a wellbore which intercepts a formation, wherein the production tubing defines a first aperture in a wall thereof and comprises a flow restrictor device, and at least one fluid pressure actuatable assembly mounted on the production tubing string;

said flow restrictor device comprising:

an insert member arranged for location in said first aperture, wherein the insert member is formed with a second aperture arranged for fluid flow therethrough and wherein the second aperture of the insert member acts as the first aperture of the production tubing;

an obstructing member arranged for movement between a first position where said obstructing member is located so as to form a seal with an edge of said second aperture and is arranged to prevent fluid flow through said second aperture, and a second position where said obstructing member is located so that the second aperture is unobstructed;

a retaining arrangement comprises a plurality of elements spaced about a periphery of said second aperture and arranged to project therefrom, for restricting possible locations of said obstructing member to said first position, second position and positions therebetween, wherein said second aperture allows fluid communication between the exterior and the interior of the production tubing;

providing pressurised fluid from a remote location internally of the production tubing to actuate the fluid pressure actuatable assembly, wherein said pressurised fluid acts on the obstructing member to move said member to seal the aperture; and reducing the pressurised fluid to cause fluid from the formation to act on the obstructing member to move said member to open the second aperture and permit flow of formation fluids through the second aperture into the production tubing.

20. The method according to claim 19, wherein the fluid pressure actuatable assembly comprises a fluid actuated packer assembly, and the method comprises providing pressurised fluid from a remote location to actuate the packer assembly to establish a seal between the production tubing string and a wall of the wellbore.

* * * * *